US005307798A

United States Patent [19]

Overmars, Sr.

[11] Patent Number: 5,307,798

[45] Date of Patent: May 3, 1994

[54] PAD FOR PORTABLE STOVE

[76] Inventor: Ben J. A. Overmars, Sr., 5323 Hyada Blvd. NE., Tacoma, Wash. 98422

[21] Appl. No.: 71,954

[22] Filed: Jun. 7, 1993

[51] Int. Cl.[5] ..... F24C 3/08

[52] U.S. Cl. ..... 126/40; 126/9 R; 126/39 B; 126/38; 126/44

[58] Field of Search ..... 126/40, 9 R, 38, 9 B, 126/39 B, 44; 431/344, 353; 248/157, 163.1

[56] References Cited

U.S. PATENT DOCUMENTS

| | | | |
|---|---|---|---|
| D. 264,928 | 6/1982 | DiFede | D7/136 |
| D. 282,340 | 1/1986 | Lam | D7/387 |
| D. 316,007 | 4/1991 | Wagner | D7/366 |
| 989,747 | 4/1911 | Yassenoff | 126/40 |
| 1,047,028 | 12/1912 | Foster et al. | 126/40 |
| 3,189,016 | 6/1965 | Corlet | 126/38 |
| 3,277,880 | 10/1966 | Kirby | 126/40 |
| 3,405,703 | 10/1968 | Axelsson et al. | 126/38 |
| 3,877,458 | 4/1975 | Allander | 126/44 |
| 4,177,790 | 12/1979 | Zenzaburo | 126/38 |
| 5,038,749 | 8/1991 | Jerry et al. | 126/40 |
| 5,065,735 | 11/1991 | Bourgeois et al. | 126/40 |

FOREIGN PATENT DOCUMENTS

| | | | |
|---|---|---|---|
| 68903 | 3/1949 | Denmark | 126/40 |
| 567455 | 3/1924 | France | 126/40 |
| 812605 | 5/1937 | France | 126/40 |
| 999427 | 1/1952 | France | 126/40 |

*Primary Examiner*—Larry Jones
*Attorney, Agent, or Firm*—Keith D. Gehr

[57] ABSTRACT

The invention is a very lightweight pad or base for use with a small portable stove such as those used by backpackers or mountaineers. It provides a stable bearing surface when the stove is used on unstable surfaces such as snow or sand. The pad comprises an exterior frame which completely encloses a spider-like structure on which the stove rests. Preferably two legs of the spider have upstanding cleats to engage the base of the stove. A third leg has an attached spring which also engages the stove base to bias it firmly against the cleats and hold the stove in place. These legs are preferably spaced about 120° apart. The spider may contain additional legs to increase strength and bearing surface. Since the cleats are of very low profile the pad is essentially planar and takes up little space in a backpack.

12 Claims, 2 Drawing Sheets

PAD FOR PORTABLE STOVE

BACKGROUND OF THE INVENTION

The present invention is a stove pad that provides a stable base for a portable stove such as those used by mountaineers, campers, and backpackers.

The popularity of mountaineering and backpacking has grown almost exponentially over the past three decades. Hiker traffic in the back country has become so heavy that in some national parks and wilderness areas access is limited to a given number of hikers in order to prevent wear on fragile meadows and camping areas. In many locations the readily available firewood has long ago been used up and management authorities now require overnight hikers to carry stoves and fuel for cooking. Such stoves have always been needed by mountaineers and other who might be camping above timberline or on snow. These stoves must be small enough to readily fit in a backpack and light enough so that they will not overly burden the hiker. Generally they weigh less than 1 kg. The stoves normally are designed to use either kerosine or white gasoline for fuel. Examples can be seen in U.S. Pat. Nos. 3,877,458 and 4,177,790.

Hikers must occasionally camp in small areas that are less than desirable from the standpoint of comfort and convenience. In many mountain areas flat surfaces for camp locations are at a high premium or unavailable. The typical camp stove has a relatively small basal area and needs a firm flat surface to hold the cooking utensils level. Snow camping poses particular problems. Even if the snow is packed hard, heat conducted and reflected from the stove will cause it to melt into the snow, usually with disastrous results for the camper's dinner. To counter this problem, campers often carry small squares of plywood or foam insulation as a stove base. Unfortunately, these improvised bases tend to be heavy and/or hard to accommodate in the limited space within a backpack. Stoves having a higher effective basal area, such as the one shown in U.S. Pat. No. 3,189,016, while sufficiently stable on solid ground, still require some sort of insulating base when used on snow.

Apparently nobody before the present inventor has seriously addressed the problem of providing a stove pad or base that gives maximum bearing surface with minimum bulk and weight and that will readily fit into a pack.

U.S. Pat. No. Des. 264,928 shows a pot or pan restraint for engaging the radial bars of a stove top grating. U.S. Pat. No. Des. 282,340 illustrates a base for a cooking pot, such as a wok. This presumably would hold the wok over a stove burner or allow it to be placed on a table. U.S. Pat. No. Des. 316,007 describes a stand for a fondue pot or similar article. While remotely similar in purpose, none of these articles addresses the problems outlined above and none would meet both requirements of light weight and minimum bulk.

SUMMARY OF THE INVENTION

The present invention comprises a pad or base suitable for providing a stable support surface for a portable stove such as those used by hikers and mountaineers. It is particularly useful for use on snow and sand or any other surface which would otherwise prove unstable for operation of the stove.

The pad is essentially planar in configuration. By "essentially planar" is meant that there are no upstanding portions of such height or configuration as to cause the pad to occupy significantly more volume when included in a backpack than would be occupied by a truly planar object.

The pad consists of an outer frame of generally circular or oval configuration although other curvilinear and straight line geometric shapes, such as regular or irregular polygons, or combinations of curvilinear and straight line forms are equally suitable. The pad is generally made of stiff light weight rod or wire. The frame entirely encloses within it a spider-like portion made of similar rod or wire. The spider has a plurality of legs with inner ends originating from a generally centrally located position and outer ends welded or otherwise permanently affixed to the frame. These legs are preferably spaced about equiangularly from each other. At least one of the legs, most preferably two or even more of them, have attached upstanding cleats. The cleat or cleats provide hooks to engage the lower portion of a stove and help to retain it on the pad. The term "cleat" should be construed sufficiently broadly so that it encompasses any functionally equivalent upstanding hook or lug. Another leg has a biasing spring or other securing device which acts against the lower portion of the stove and presses it tightly against the clear or cleats so that the stove is firmly retained on the pad. When a spring is used it is most preferably coaxially situated and readily slidable along the spider leg. Depending on the configuration of the particular stove, the end of the spring not in engagement with the stove will bear either against the frame or the junction point of the spider legs. In the most preferred configuration two spider legs will have cleats and they will be spaced about 120° from each other and from the leg with the securing device. Additional spider legs may be present to provide added strength and bearing surface.

Using the construction described, a stove pad about 320 mm in total length and 210 mm width can be made so as to weight no more than about 40 g (1.3 oz). The maximum height at the cleat location is only 12 to 14 mm.

It is an object of the present invention to provide a pad or base for a portable stove that provides stability on almost any substrate surface.

It is a further object to provide a pad or base for a stove that provides an efficient bearing surface for use of the stove directly on lightly packed snow or on sand.

It is another object to provide a pad or base for a stove that is extremely light weight and will fit easily within a backpack while occuping negligible volume.

These and many other objects will become readily apparent to those skilled in the art upon reading the following detailed description while referring to the accompanying drawings.

DETAILED DESCRIPTION OF THE PREFERRED EMBODIMENTS

Figure 1:
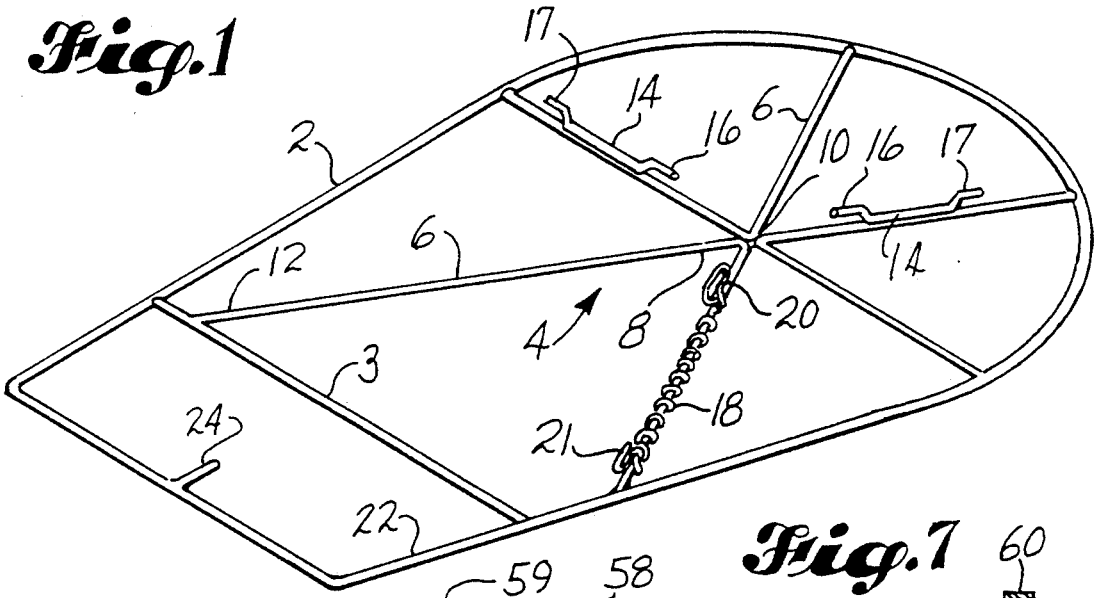
FIG. 1 is a perspective view of the stove pad seen from above left.
Figure 3:
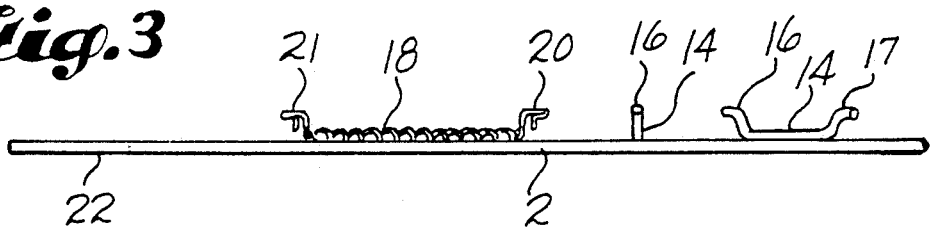
FIG. 3 is a side elevation of the pad.
Figure 2:
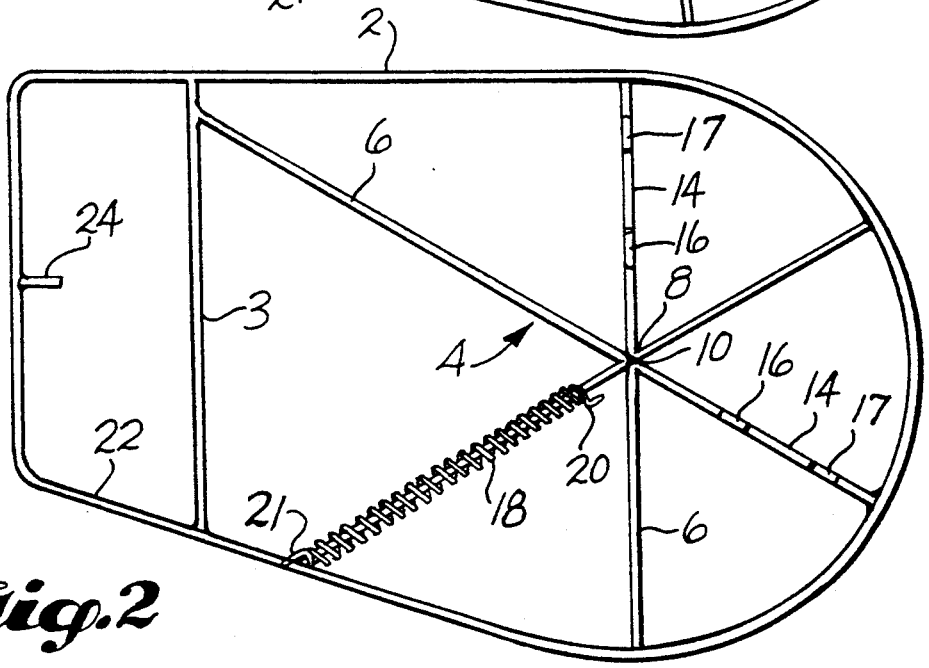
FIG. 2 is a top plan view of the pad.

Referring now to the drawings, particularly FIGS. 1–3, the stove pad comprises an outer frame 2 made of lightweight rod or wire, for example 11 gauge steel wire or 3.2 mm (⅛ in) aluminum rod of a hard alloy such as 6061 T6 aluminum. Enclosed within it is a spider like structure generally shown at 4. This consists of a plurality of legs 6 having inner ends 8 joined together by welding or other means at a generally central point 10. The outer ends 12 of the spider legs are similarly joined to frame 2.

At least one, most preferably two, of the spider legs have upstanding cleats 14 located with their center points about 60% of the distance outward fron the center point 10 of the spider. The cleats may have a single hook end but preferably are double ended as at 16 and 17 to accommodate different stove configurations, as will be explained later. A third leg of the spider has a securing device, in this case a slidable spring 18 coaxially located about it. As is the case with the cleats, this may have a single hooked end but preferably has both ends formed into upstanding hooks 20, 21.

Optionally. the pad may have an extension for holding a fuel bottle This extension is formed by member 3, which forms one portion of the outer frame, and member 22. A stud 24 is preferably included. This stud forms a location for attaching one end of a bungee cord or similar means to hold the fuel bottle in place. The other end of the bungee cord can be hooked over frame portion 3.

Figure 4:
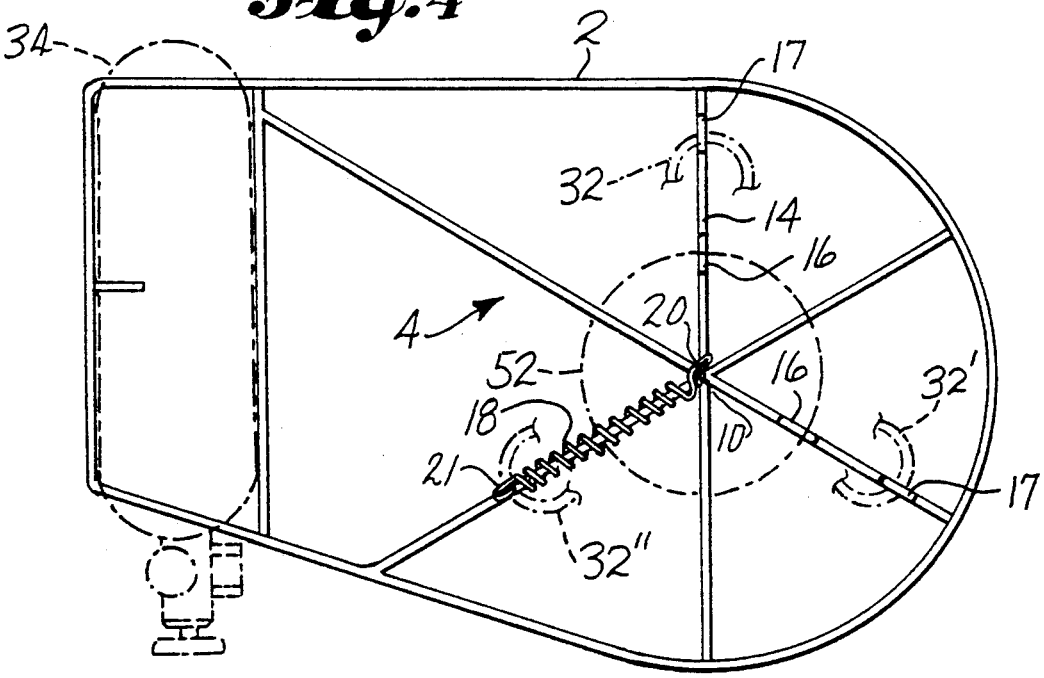
FIG. 4 is a top plan view showing in phantom detail the basal outlines of two different types of stoves in place on the pad.

Referring now to FIG. 4, the basal portions of two different stove types are shown in dashed lines as they would be in position on the pad. A first type, generally seen at 30 in FIG. 5, has three wire loops 32, 32′, and 32″ for legs. As seen in FIG. 4 two of these legs 32 and 32′ are placed under the hooked outer ends 16 of cleats 14. The third leg 32″ of the stove is engaged by the outer end 21 of biasing spring 18. The inner end 20 of spring 18 is engaged against the central weld point 10 of the spider so as to place the spring in compression. The compressed spring forces the stove leg 32″ that it engages outwardly so that the other two legs are drawn tightly under the outer ends 17 of cleats 14. A fuel bottle 34 is seen located at the extension of the frame defined by members 3 and 22.

Figure 6:
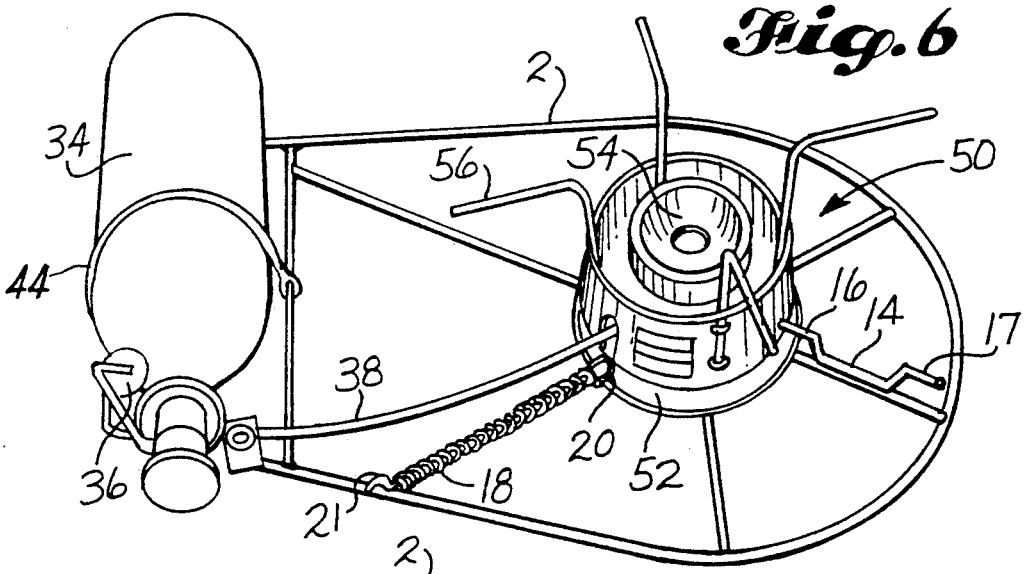
FIG. 6 is a perspective view showing another stove type mounted on the pad.

When a stove of the other type is used, such as is seen generally at 50 in FIG. 6, the base 52, which has a slight flange, is located under the inner ends 16 of cleats 14. In this case inner end 20 of the spring 18 bears against stove base 52 to press it tightly against cleats 14. Now the outer end 21 of spring 18 would bear against frame 2 to keep the spring in compression.

Figure 5:
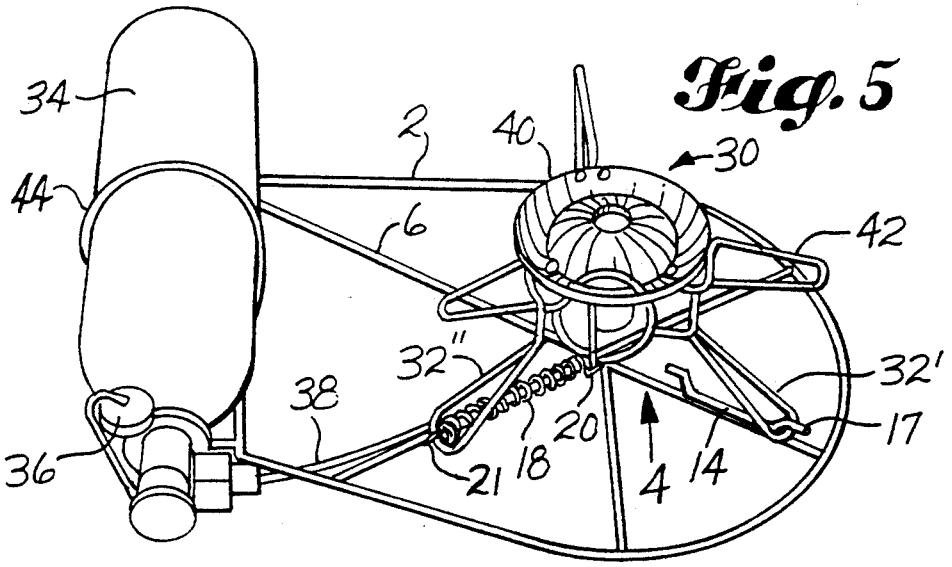
FIG. 5 is a perspective view showing one stove type mounted on the pad.

FIG. 5 shows a stove 30 of the first type in place on the pad. This has three legs 32, legs 32 and 32′ being hooked under outer ends 17 of cleats 14, and the other leg 32″ being engaged by outer end 21 of spring 18, as was described above. In addition to the three legs, stove 30 has an external fuel bottle 34 equipped with a control valve 36 and fuel line 38 which carries fuel to burner 40. It also has three wire wings 42 which form a support surface for a pot or similar cooking utensil. A bungee cord 44 secures the fuel bottle to the frame extension.

FIG. 6 indicates a stove 50 of the second type in position. As was described for FIG. 4, the basal flange is hooked under the inner ends 16 of cleats 14. In this case the inner end 20 of spring 18 engages the stove base to press it firmly against the cleats. The fuel supply system for burner portion 54 is as was described for stove 30. It might be noted that many stoves of the general basal configuration of stove 50 have an integral fuel reservoir and do not require the external fuel bottle.

Figure 7:
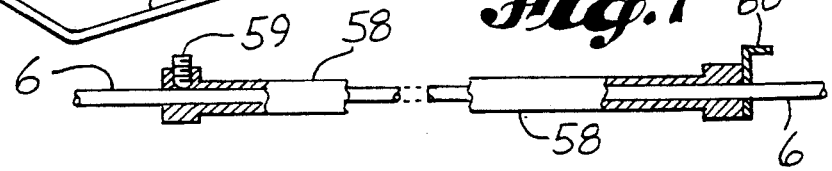
FIG. 7 shows an alternative securing mechanism for a stove.

FIG. 7 shows one of several alternative methods to the use of spring 18 for securing the stove to the pad. Here a metal tube 58 is slidably located around spider leg 6. This has hooked ends 60 at one or both ends. When in position it is held by a set screw 59. As an alternative to the set screw, springs, not shown, may be used both inboard and outboard of the tube on leg 6. If the use only of stoves having a common basal type is contemplated, many other standard latching devices can be used.

Having thus set forth the best mode of constructing and using the present invention, it will be readily apparent to those skilled in the art that many variations not shown here can be made without departing from the spirit of the invention. Thus, the invention should be considered as limited only as it is described in the following claims.

I claim:

1. An essentially planar stove pad offering a stable support surface for a portable stove which comprises:
   - a frame:
   - an spider means enclosed within the frame, said spider means having a plurality of spaced apart legs, said legs having inner ends originating from a generally central location within the frame and outer ends attached to the frame;
   - at least one upstanding cleat attached to one of said legs to engage and provide a retaining means for a stove; and
   - a securing means associated with another of said legs, said securing means having at least one upturned end to engage a stove and force the stove against the at least one cleat in order to firmly hold the stove in position on the pad.

2. The stove pad of claim 1 in which the spider means has at least three legs and the legs are spaced essentially equiangularly from each other.

3. The stove pad of claim 2 having two cleats to engage the stove.

4. The stove pad of claim 3 in which the spider means has six legs and the cleats and securing means are located on alternate legs.

5. The stove pad of claim 1 in which the securing means is a spring coaxially and slidably located around the spider leg.

6. The stove pad of claim 1 in which the cleats and securing means are double ended in order to accommodate stoves of different sizes.

7. The stove pad of claim 1 in which the outer frame has an extended portion to accommodate a horizontally disposed fuel bottle 8. The stove pad of claim 1 further in combination with a portable stove.

9. An essentially planar stove pad offering a stable support surface for a portable stove which comprises:
   - a frame:
   - a spider means enclosed within the frame, said spider means having at least three spaced apart legs, each leg having an inner end originating from a generally central location within the frame and an outer end attached to the frame;

upstanding cleats attached to two of said legs to engage and provide a retaining means for a stove; and a slidable spring located coaxially around another of said legs, said spring having upturned ends to engage a stove and force the stove against the cleats so as to firmly hold the stove in position on the pad, said cleats and spring being angularly spaced about 120° from each other.

10. The stove pad of claim 9 in which the cleats and spring and are double ended in order to retain stoves of different sizes.

11. The stove pad of claim 9 in which the outer frame has an extended portion to accommodate a horizontally disposed fuel bottle.

12. The stove pad of claim 9 further in combination with a portable stove.

* * * * *